US008059402B2

(12) United States Patent
Hsieh

(10) Patent No.: US 8,059,402 B2
(45) Date of Patent: Nov. 15, 2011

(54) HEAT SOURCE RECYCLING UNIT AND HEAT SOURCE RECYCLING SYSTEM USING THE SAME

(75) Inventor: Hsing-Yuan Hsieh, Shindian (TW)

(73) Assignee: FIH (Hong Kong) Limited, Kowloon (HK)

( * ) Notice: Subject to any disclaimer, the term of this patent is extended or adjusted under 35 U.S.C. 154(b) by 238 days.

(21) Appl. No.: 12/567,916

(22) Filed: Sep. 28, 2009

(65) Prior Publication Data

US 2010/0276113 A1 Nov. 4, 2010

(30) Foreign Application Priority Data

Apr. 30, 2009 (CN) ..... 200910302061

(51) Int. Cl.

| | |
|---|---|
| ***H05K 7/20*** | (2006.01) |
| ***H05K 5/00*** | (2006.01) |
| ***F28D 17/00*** | (2006.01) |
| ***F28F 9/007*** | (2006.01) |

(52) U.S. Cl. ..... 361/695; 165/10; 165/67; 361/694; 454/184

(58) Field of Classification Search ..... 361/694, 361/695; 454/184

See application file for complete search history.

(56) References Cited

U.S. PATENT DOCUMENTS

| | | | | |
|---|---|---|---|---|
| 5,457,603 | A * | 10/1995 | Leeb | 361/698 |
| 6,506,111 | B2 * | 1/2003 | Sharp et al. | 454/184 |
| 6,574,104 | B2 * | 6/2003 | Patel et al. | 361/695 |
| 6,822,861 | B2 * | 11/2004 | Meir | 361/695 |
| 6,963,488 | B1 * | 11/2005 | Chen | 361/679.49 |
| 7,312,995 | B2 * | 12/2007 | Wilson et al. | 361/701 |
| 7,403,391 | B2 * | 7/2008 | Germagian et al. | 361/695 |
| 7,455,101 | B2 * | 11/2008 | Hsu | 165/104.33 |
| 2006/0151146 | A1 * | 7/2006 | Chou et al. | 165/10 |

* cited by examiner

*Primary Examiner* — Gregory Thompson
(74) *Attorney, Agent, or Firm* — Altis Law Group, Inc.

(57) ABSTRACT

A heat source recycling unit includes at least one heat removing device, a heat source conversion device and a heat preservation box. The heat removing device includes a heat inlet end connects with the pre-recycling heat source and, a heat outlet end connects with the heat source conversion device. The heat preservation box includes a heat preservation room and a refrigeration room. The heat source conversion device converts the received heat energy into heat energy and cold energy, and then transmits them to the heat preservation room and the refrigeration room respectively. The invention also provides a heat source recycling system.

16 Claims, 3 Drawing Sheets

HEAT SOURCE RECYCLING UNIT AND HEAT SOURCE RECYCLING SYSTEM USING THE SAME

BACKGROUND

1. Technical Field

The exemplary disclosure generally relates to heat source recycling units, and particularly, relates to a heat source recycling unit for recycling excessive heat output by an electronic device such as computer and a heat source recycling system using the same.

2. Description of Related Art

With the development of technologies and the popularization of electronics, computers are now in widespread use, and consumers may now enjoy the full convenience of high technology electronic products such as computers almost anytime and anywhere. People often need to use computer in their daily life for work and pleasure. Electronic components assembled within the computer (such as the CPU, the main board, etc. assembled within the mainframe thereof) often output lots of heat energy during the working process.

However, the heat energy output by the computer are often transmitted or emitted to the outside of the mainframe of the computer by heat sinks and radiator fans, accordingly, the heat energy is not utilized and becomes waste.

Therefore, there is room for improvement within the art.

BRIEF DESCRIPTION OF THE DRAWINGS

Many aspects of the exemplary heat source recycling unit and heat source recycling system using the same can be better understood with reference to the following drawings. These drawings are not necessarily drawn to scale, the emphasis instead being placed upon clearly illustrating the principles of the present heat source recycling unit and heat source recycling system using the same. Moreover, in the drawings like reference numerals designate corresponding parts throughout the several views. Wherever possible, the same reference numbers are used throughout the drawings to refer to the same or like elements of an embodiment.

DETAILED DESCRIPTION

Figure 1:
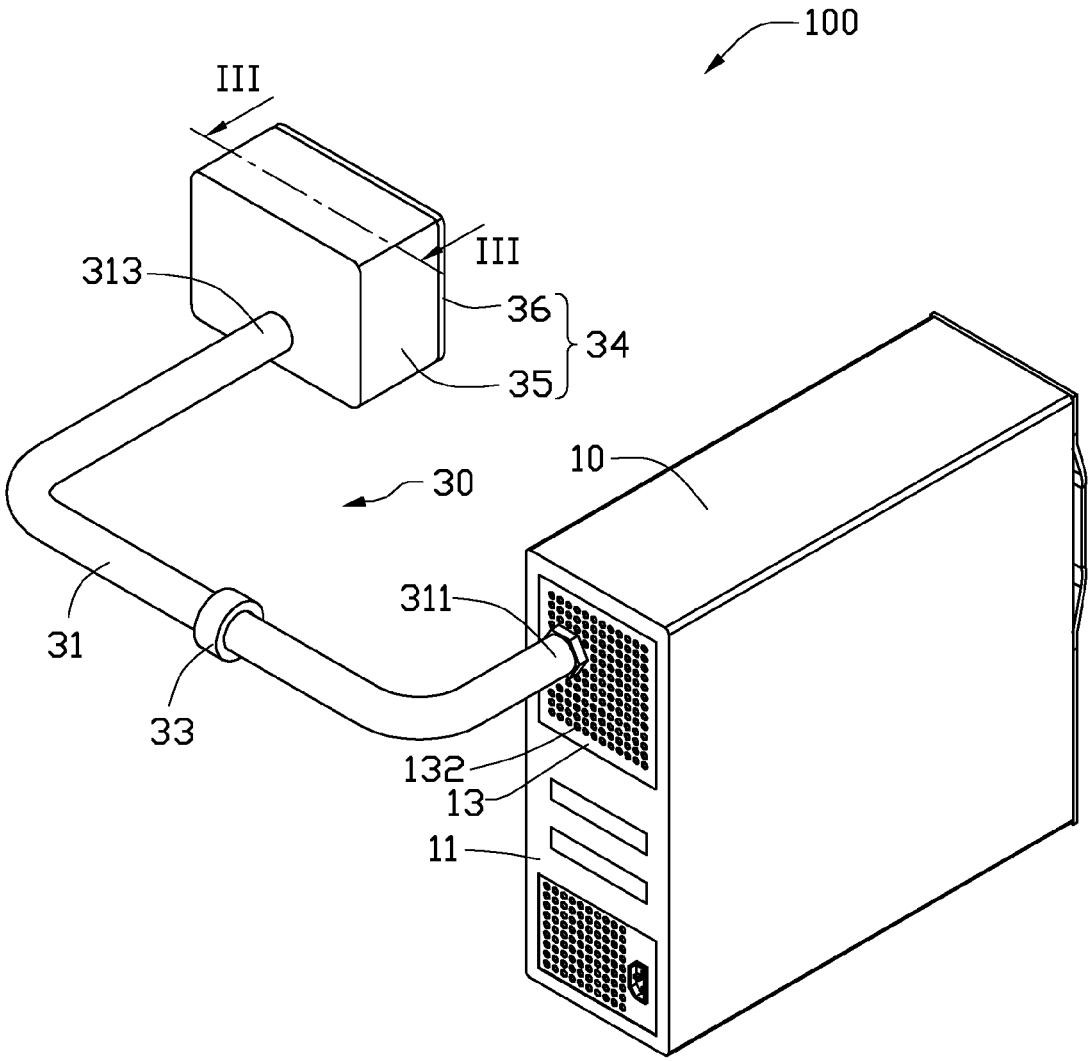
FIG. 1 shows a perspective view of a heat source recycling system according to an exemplary embodiment.

FIG. 1 shows a perspective view of a heat source recycling system according to an exemplary embodiment. The heat source recycling system 100 includes e.g. a computer mainframe 10 and a heat source recycling unit 30. The computer mainframe 10 includes a back panel 11 and several electronic components (not shown) such as CPU, main board, heat sinks, radiator fans, etc. assembled within the computer mainframe 10. The back panel 11 defines a heat dissipation area 13 for transmitting/eliminating the heat output by the electronic components within the computer mainframe 10 to the outside. In the exemplary embodiment, the heat dissipation area 13 includes several heat dissipation holes 132 defined through back panel 11. The heat sinks are attached to or mounted on the CPU to dissipate heat. The radiator fans are assembled within the computer mainframe 10 and located near the heat dissipation area 13 of the back panel 11 to expel the heat energy formed within the computer mainframe 10.

Figure 2:
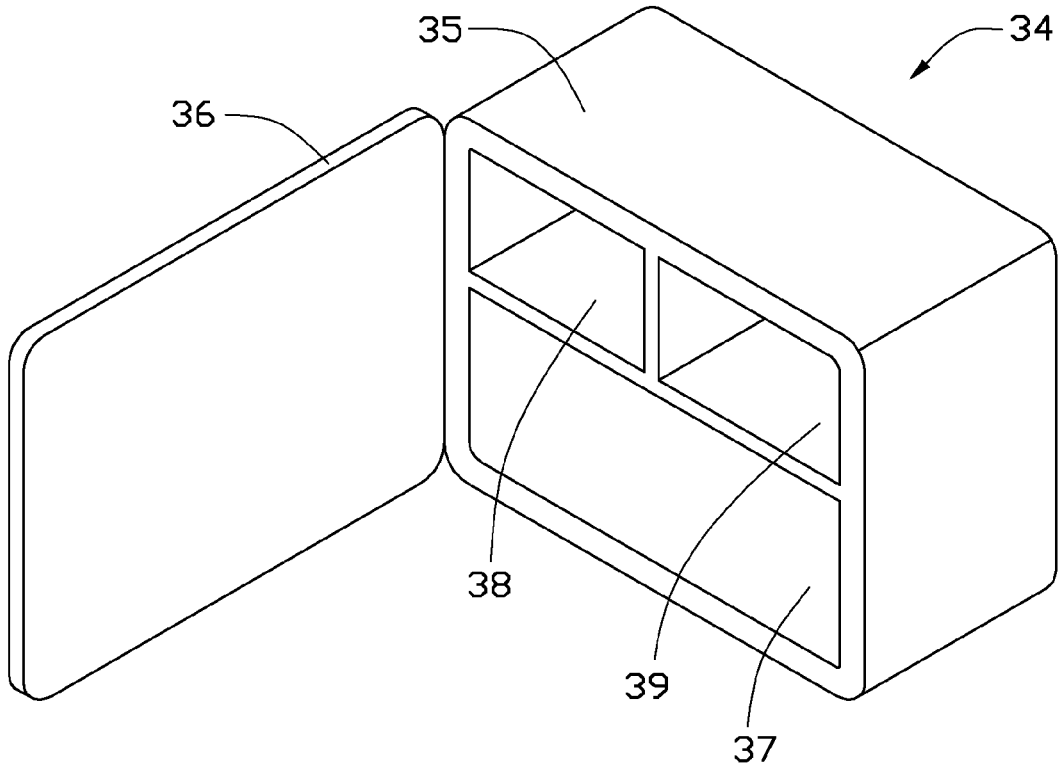
FIG. 2 shows a perspective view of the heat preservation box of the heat source recycling unit according to an exemplary embodiment.

Also referring to FIG. 2, the heat source recycling unit 30 is fixed to a waste heat source, such as the heat sinks, or the heat dissipation area 13 of the back panel 11 of the computer mainframe 10, to obtain heat energy output by the computer mainframe 10. The heat source recycling unit 30 includes at least one heat removing device 31, a filter device 33 and a heat preservation box 34. In the exemplary embodiment, the heat removing device 31 includes a superconducting duct with high-thermal conductivity. An inner wall of the superconducting duct is coated with a metal powder layer such as yttrium, barium and other heat superconducting material. The heat removing device 31 is used to transfer the heat energy to the heat preservation box 34 and includes a heat inlet end 311 and a heat outlet end 313. The heat inlet end 311 is connected to the heat dissipation area 13 of the back panel 11 or the heat sinks assembled within the computer mainframe 10 for obtaining heat energy output by the computer mainframe 10.

The filter device 33 is disposed in between the heat inlet end 311 and the heat outlet end 313 of the heat removing device 31 to filter out water vapor, smudge, dust, etc. contained in the heat source. In the exemplary embodiment, the filter device 33 is a filter screen. It is to be understood that the filter device 33 could further include a blowing device (not shown) to pump the air within the heat source recycling unit 30 to conduct the heat quickly.

The heat preservation box 34 is connected to the heat outlet end 313 of the heat removing device 31 to absorb the heat gathered from the computer mainframe 10. The heat preservation box 34 includes a box body 35 and a door 36 rotatably assembled to the box body 35. The box body 35 includes a heat source conversion device 37, a heat preservation room 38 and a refrigeration room 39. In the exemplary embodiment, the box body 35 has a double-deck structure. The heat source conversion device 37 is disposed at bottom floor of the box body 35. The heat preservation room 38 and the refrigeration room 39 are substantially rectangular cavity shaped and disposed upon the heat source conversion device 37, next to each other. The outer circumferential or periphery of the heat preservation room 38 and the refrigeration room 39 are disposed/coated with an insulating layer to further improve the preservation time and avoid the loss of heat energy. The insulating layer is made of heat insulation, cold insulation materials such as styrofoam or foamed plastic.

Figure 3:
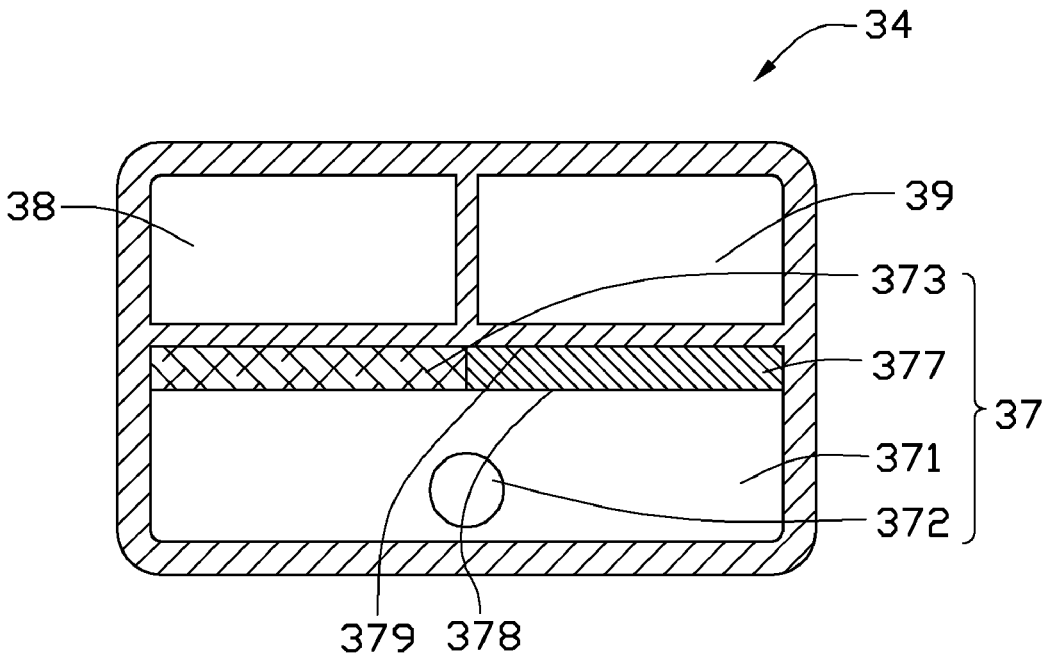
FIG. 3 shows a cross-sectional view taken along line of the FIG. 1.

Also referring to FIG. 3, the heat source conversion device 37 includes a heat source collecting room 371, a heat conducting piece 373 and a refrigeration piece 377. The heat source collecting room 371 is a hollow cavity. The inner wall of the heat source collecting room 371 is made of or coated with heat assimilating material. The heat source collecting room 371 defines a fixing hole 372 therethrough for connecting with the heat outlet end 313 of the heat removing device 31 to receive the heat energy. The heat conducting piece 373 is made of heat conducting material and is attached to top wall of the heat source collecting room 371 which is a bottom wall of the heat preservation room 38 to transfer the heat energy to the heat preservation room 38. The refrigeration piece 377 is a refrigeration chip configured for converting the heat energy into cold energy. In the exemplary embodiment, the refrigeration chip has a heat absorbing surface 378 and a refrigeration surface 379 opposite to the heat absorbing surface 378. As the refrigeration chip is electrified, the heat absorbing surface 378 absorbs the heat energy and the refrigeration surface 379 outputs the cold energy correspondingly. The refrigeration chip is attached to the top wall of the heat source collecting room 371 with its heat absorbing surface 378 facing to the heat source collecting room 371 and the refrigeration surface 379 tightly contacting with bottom wall of the refrigeration room 39 to transfer the cold energy converted by the refrigeration chip to the refrigeration room 39.

When the heat source recycling system 100 is working, the heat energy dissipated from the computer mainframe 10 is expelled out by the radiator fan (not shown) from the heat dissipation area 13 of the back panel 11. The heat removing device 31 of the heat source recycling unit 30 collects and transfers the heat energy to the heat source collecting room 371 of the heat preservation box 34 after filtering/removing the water vapor, smudge, dust, etc. of the heat source by the filter device 33. The heat absorbing surface 378 of the refrigeration chip absorbs the heat energy from the heat energy collecting room 371 and outputs a cold energy on its refrigeration surface 379 correspondingly for being conducted to the refrigeration room 39 to form a low temporary environment to refrigerate the items. The heat energy gathered within the heat source collecting room 371 is conducted to the heat preservation room 38 directly to preserve the items stored therein.

It is to be understood that the heat source recycling unit 30 is not limited to the structure of the exemplary embodiment, the heat source conversion device 37 may also be disposed in between the filter device 33 and the heat preservation box 34, accordingly, the heat preservation box 34 is made up of the a heat preservation room 38 and a refrigeration room 39. The refrigeration piece 377 is assembled within the heat removing device 31 with the heat absorbing surface 378 facing to the filter device 33 side to absorb the heat energy filtered by the filter device 33 and outputs the cold energy on the refrigeration surface 379 correspondingly to be transmit to the refrigeration room 39. The heat conducting piece 373 is a conducting duct, one end of the heat conducting piece 373 is fixed to the position of heat removing device 31 between the heat absorbing surface 378 of the refrigeration chip and the filter device 33, the opposite end of the heat conducting piece 373 is fixed to the heat preservation room 38 to transmit the heat energy to the heat preservation room 38.

It is to be understood that the heat preservation box 34 may further includes an air pressure valve disposed thereon to control the air pressure and adjust the temperature within the preservation box 34.

It is to be understood, however, that even through numerous characteristics and advantages of the exemplary invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heat source recycling unit, comprising:

a heat removing device comprising a heat inlet end for collecting/obtaining a pre-recycling heat source and a heat outlet end;

a heat preservation box connected to the heat outlet end to receive the heat source, the heat preservation box having a heat preservation room and a refrigeration room; and a heat source conversion device assembled within the heat preservation box and configured for converting the received heat source into heat energy and cold energy, and transmitting the heat energy and cold energy to the heat preservation room and the refrigeration room respectively.

2. The heat source recycling unit as claimed in claim 1, wherein the heat conversion device includes a heat conducting piece made of heat conducting material for transferring the heat energy to the heat preservation room and a refrigeration piece configured for converting the heat energy into cold energy.

3. The heat source recycling unit as claimed in claim 2, wherein the heat removing device is a bendable superconducting duct with high-thermal conductivity, the inner wall of the superconducting duct is coated with a metal powder layer.

4. The heat source recycling unit as claimed in claim 2, wherein the refrigeration piece is a refrigeration chip having a heat absorbing surface and a refrigeration surface opposite to the heat absorbing surface; as the refrigeration chip is electrified, the heat absorbing surface absorbs the heat energy and the refrigeration surface outputs the cold energy correspondingly.

5. The heat source recycling unit as claimed in claim 4, wherein the heat source conversion device further includes an hollow cavity shape heat source collecting room disposed at the bottom of the heat preservation box, the heat source collecting room defines a fixing hole therethrough connected to the heat outlet end of the heat removing device; the refrigeration chip is attached to the top wall of the heat source collecting room with its heat absorbing surface facing to the heat source collecting room and the refrigeration surface tightly contacting with the bottom wall of the refrigeration room.

6. The heat source recycling unit as claimed in claim 5, wherein the inner wall of the heat source collecting room is made of or coated with heat assimilating material.

7. The heat source recycling unit as claimed in claim 5, wherein the heat source recycling unit further includes a filter device disposed in between the heat inlet end and the heat out let end of the heat removing device to filter the heat source.

8. A heat source recycling unit, comprising:

a heat removing device comprising a heat inlet end for collecting/obtaining a pre-recycling heat source and a heat outlet end;

a heat preservation box connected to the heat outlet end to receive the heat source, the heat preservation box having a heat preservation room and a refrigeration room;

a heat conducting piece connecting with the heat outlet end of the heat removing device and the heat preservation box for conducting the heat source to the heat preservation box; and a heat source conversion device connecting with heat outlet end and the refrigeration room of the heat preservation box and configured for converting the received heat source into cold energy and transmitting the cold energy to the refrigeration room.

9. The heat source recycling unit claimed in claim 8, wherein the refrigeration piece is a refrigeration chip having a heat absorbing surface and a refrigeration surface opposite to the heat absorbing surface, the refrigeration piece is assembled within the heat removing device with the heat absorbing surface facing a side of the heat preservation box to absorb the heat source and outputs the cold energy on the refrigeration surface correspondingly to be transmit to the refrigeration room.

10. The heat source recycling unit claimed in claim 9, wherein the heat source recycling unit further includes a filter device disposed in between the heat inlet end and the heat outlet end of the heat removing device to filter the heat source, the heat conducting piece disposed between the filter device and the heat preservation box.

11. A heat source recycling system comprising:

a computer mainframe comprising a back panel and several electronic components such as CPU, main board, heat sinks, radiator fans assembled there within, the back panel defining a heat dissipation area for eliminating the heat given out by the electronic components assembled within the computer mainframe to the outside; and a heat source recycling unit comprising:

a heat removing device comprising a heat inlet end fixed to the heat sinks or the heat dissipation area of the back panel for collecting/obtaining the heat energy given out by the computer mainframe and a heat outlet end;

a heat preservation box connected to the heat outlet end to receive the heat energy, the heat preservation box having a heat preservation room and a refrigeration room; and a heat source conversion device assembled within the heat preservation box and configured for converting the received heat energy into heat energy and cold energy, and transmitting the heat energy and cold energy to the heat preservation room and the refrigeration room respectively.

12. The heat source recycling system as claimed in claim 11, wherein the heat dissipation area includes several heat dissipation holes defined there through.

13. The heat source recycling system as claimed in claim 12, wherein the heat conversion device includes a heat conducting piece made of heat conducting material for transferring the heat energy to the heat preservation room and a refrigeration piece configured for converting the heat energy into cold energy.

14. The heat source recycling system as claimed in claim 13, wherein the refrigeration piece is a refrigeration chip having a heat absorbing surface and a refrigeration surface opposite to the heat absorbing surface; as the refrigeration chip is electrified, the heat absorbing surface absorbs the heat energy and the refrigeration surface outputs the cold energy correspondingly.

15. The heat source recycling system as claimed in claim 14, wherein the heat source conversion device further includes an hollow cavity shape heat source collecting room disposed at the bottom of the heat preservation box, the heat source collecting room defines a fixing hole therethrough connected to the heat outlet end of the heat removing device; the refrigeration chip is attached to the top wall of the heat source collecting room with its heat absorbing surface facing to the heat source collecting room and the refrigeration surface tightly contacting with the bottom wall of the refrigeration room.

16. The heat source recycling system as claimed in claim 15, wherein the heat source recycling unit further includes a filter device disposed in between the heat inlet end and the heat outlet end of the heat removing device to filter the heat energy source.

* * * * *